United States Patent [19]

Moulin

[11] Patent Number: 4,575,266

[45] Date of Patent: Mar. 11, 1986

[54] CHARACTER-CARRYING DISC FOR A PRINTING MACHINE

[75] Inventor: Blaise Moulin, Corcelles, Switzerland

[73] Assignee: Caracteres S.A., Neuchatel, Switzerland

[21] Appl. No.: 669,109

[22] Filed: Nov. 7, 1984

[30] Foreign Application Priority Data

Nov. 25, 1983 [CH] Switzerland ..... 6320/83

[51] Int. Cl.[4] ..... B41J 1/30

[52] U.S. Cl. ..... 400/144.2; 400/175

[58] Field of Search ..... 400/139, 140, 144, 144.1, 400/144.2, 174, 175

[56] References Cited

U.S. PATENT DOCUMENTS 4,264,222 4/1981 Bauer ..... 400/144.2 X
4,465,387 8/1984 Seitz et al. ..... 400/144.2 X

FOREIGN PATENT DOCUMENTS 2855503 7/1980 Fed. Rep. of Germany ..... 400/175
3140177 4/1983 Fed. Rep. of Germany ... 400/144.2
8105753 7/1983 Netherlands ..... 400/144.2
825349 4/1981 U.S.S.R. ..... 400/144.2

OTHER PUBLICATIONS

Xerox Disc. Journal, "Daisy Print Wheel Retainer", Edstrom et al., vol. 4, No. 1, Jan./Feb. 1979, pp. 23–24.
Xerox Disc. Journal, "Print Wheel Removal Assist Means", Frechette, vol. 4, No. 2, Mar./Apr. 1979, pp. 175–176.

*Primary Examiner*—Edgar S. Burr
*Assistant Examiner*—James R. McDaniel
*Attorney, Agent, or Firm*—Silverman, Cass & Singer

[57] ABSTRACT

A character-carrying disc made of plastic material is provided, on its front face, with four protrusions each provided with a circular-arc shaped blade, coaxial with a central mounting hole of the disc. Each blade is itself provided with a projection protruding radially inwardly of the central hole of the disc. These rolls are adapted to engage, by resilient deformation of the blades, in an annular groove provided in the end of a shaft of the machine on which the disc is mounted.

5 Claims, 4 Drawing Figures

CHARACTER-CARRYING DISC FOR A PRINTING MACHINE

BACKGROUND OF THE INVENTION

The present invention relates to a character-carrying disc of the daisy wheel type for a printing machine.

SUMMARY OF THE INVENTION

The object of the invention is to provide a simple, efficient, easily operated, reliable and low manufacturing cost means for ensuring the securing of a character-carrying disc for a printing machine on a shaft of the machine.

This object is achieved due to the fact that the character-carrying disc according to the invention has at least a blade-shaped portion having the shape of an arc of circle, coaxial with a central hole of the disc, and projecting at least partially beyond said hole, the projecting part of said blade-shaped portion being adapted to cooperate with the shaft of the machine on which the disc is mounted, so as to retain the disc in place on said shaft.

The various features of the invention will be apparent from the following description, drawings and claims, the scope of the invention not being limited to the drawings themselves as the drawings are only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 1:
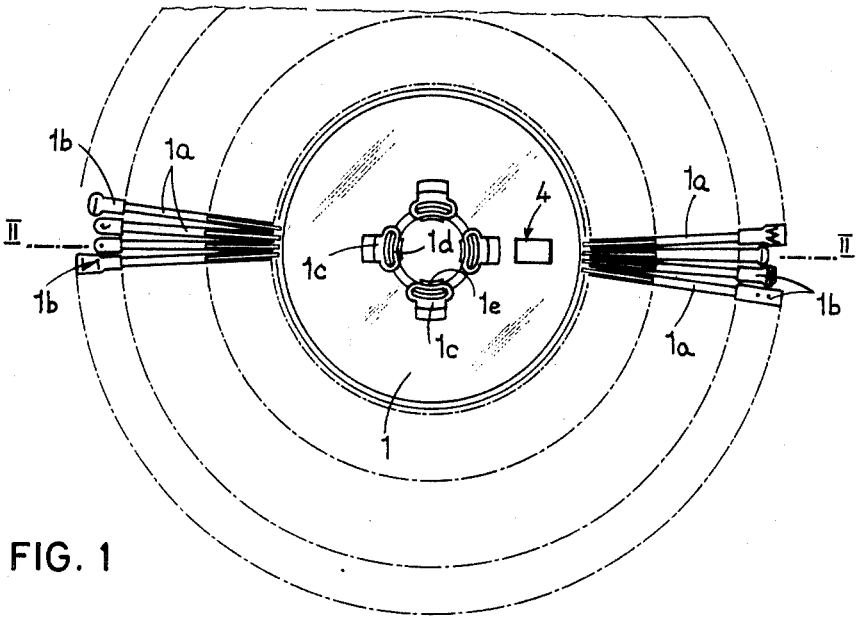
FIG. 1 is a partial plan view of a part of a character-carrying disc for a printing machine, for instance an office typing machine.
Figure 2:
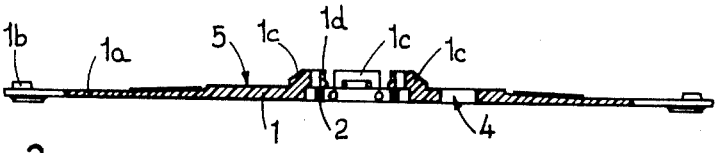
FIG. 2 is a sectional view along line II—II of FIG. 1.
Figure 3:
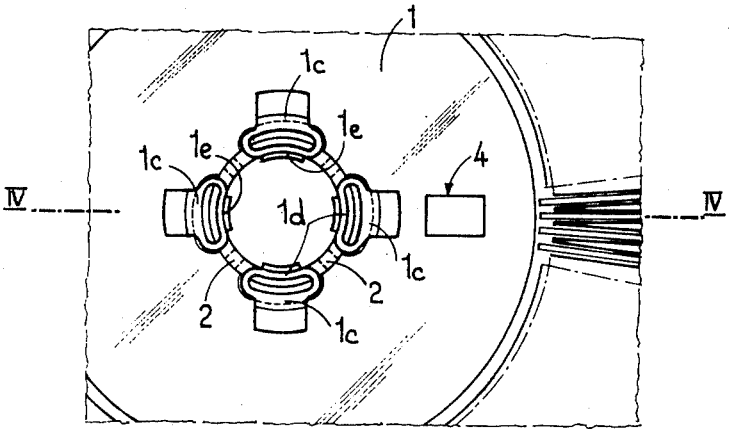
FIG. 3 is a plan view of a part of this disc, on a larger scale.
Figure 4:
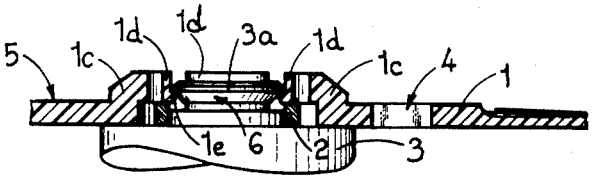
FIG. 4 is a section of a detail, along line IV—IV of FIG. 3, in which there is additionally shown the end of the shaft of the machine on which is mounted the disc is mounted.

The disc illustrated and preferably made of plastic material is designated by reference 1. It is provided with resiliently deformable arms 1*a* carrying, at their radially outer ends, characters designated by reference 1*b*. This disc is provided with a central hole which is provided with a metal bush 2 enabling it to be mounted on an end journal 3*a* of the shaft of the machine which carries it, indicated at 3 in FIG. 4. A rectangular through aperture 4 is formed in disc 1 for the passage of a driving finger of the said machine.

The disc is provided, on its front face, designated by reference 5, with four protrusions 1*c* equi-angularly distributed around its central hole, and which each present a circular-arc shaped blade 1*d* coaxial with the central hole of the disc. The four blades 1*d* are each provided, on the concave radially inner face opposite the central hole of the disc, with a curved projection 1*e* which projects inwardly into the central hole beyond the ring 2.

When the disc is engaged on the end journal 3*a* of the shaft 3 of the machine, the blades 1*d* are resiliently deformed, the end of the journal 3*a* being bevelled to this end and to cause the projections 1*e* to move radially outwards and then to recover and engage an annular groove 6 of the journal 3*a*. Such engagement maintains the disc in place on the shaft.

It is to be noted that the central bush 2 on which the blades 1*d* bear axially serves not only to ensure that the central hole of the disc is of precise diameter, in terms of centering, which is important to ensure that the disc operates satisfactorily, but it also plays a supplementary role in that it has the effect that the blades 1*d* do not have to be entirely protruding within the central hole which, for manufacturing reasons, would necessarily be the case if the bush were not present. As a matter of fact, if the material of the disc itself were extended up to the place occupied by the bush 2, the blades 1*d* would then be attached to the material of the disc, at this position so that they would lose their flexibility.

The number of the blades 1*d* could be less than four, for instance three or two, or even only one.

The disc and its securing means are manufactured by molding in a mold in which the ring 2 has been previously placed, so that they are not expensive to make. Moreover, mounting of the disc on the shaft 3 of the machine and its removal therefrom are particularly easy.

I claim:

1. A character-carrying disc for a printing machine, which machine has a disc mounting shaft, said disc having a central mounting hole therein, a metal bush within said disc defining said mounting hole, a plurality of closed loop resilient blade members formed integrally with said disc and coaxial with said hole, and each having a portion extending partially over said hole to cooperate with said mounting shaft in order to retain the disc in place thereon, said blade members flexing radially to permit said disc to be installed on and removed from said shaft.

2. A disc as defined in claim 1 wherein each blade extends above said hole and is in sliding contact with said bush.

3. A disc as defined in claim 1 wherein the disc is formed of plastic material.

4. A disc as defined in claim 1 wherein the portion of the blade extending partially over said hole comprises an integral curved projection on a concave inner face of the blade, adopted to engage within a groove on the machine shaft.

5. A disc as defined in claim 1 wherein said blades are equi-angularly spaced around said mounting hole.

* * * * *